United States Patent [19]

Marcy

[11] 4,391,111

[45] Jul. 5, 1983

[54] LATCHING MECHANISM FOR DISPENSER APPARATUS

[75] Inventor: Russell A. Marcy, Watertown, Conn.

[73] Assignee: Waterbury Companies, Inc., Waterbury, Conn.

[21] Appl. No.: 273,137

[22] Filed: Jun. 12, 1981

[51] Int. Cl.[3] ..... B65D 55/14; E05B 15/06

[52] U.S. Cl. ..... 70/162; 70/346

[58] Field of Search ..... 70/158, 159, 160, 161, 70/162, 345, 346; 292/228

[56] References Cited

U.S. PATENT DOCUMENTS

| | | | |
|---|---|---|---|
| 925,122 | 6/1909 | Merlonetti . | |
| 980,458 | 1/1911 | Tower | 292/228 |
| 1,534,965 | 4/1925 | Keeler . | |
| 1,804,955 | 5/1931 | Schlumpf | 70/346 |
| 1,888,918 | 11/1932 | Godden . | |
| 1,891,214 | 12/1932 | Falk . | |
| 2,162,930 | 6/1939 | Bart | 70/161 |
| 3,744,286 | 7/1973 | Trainor . | |
| 3,930,388 | 1/1976 | Barras . | |
| 4,226,101 | 6/1979 | Lee . | |

FOREIGN PATENT DOCUMENTS

| | | | |
|---|---|---|---|
| 696488 | 10/1964 | Canada | 70/161 |

*Primary Examiner*—Robert L. Wolfe

*Attorney, Agent, or Firm*—Pennie & Edmonds

[57] ABSTRACT

A dispenser including a casing formed by a body member and a closure member. A stationary latching element is carried by a container for a consumable within the body member and a movable latching element is carried by the closure member. A key is received through the closure member to interact with the movable latching element to move the same from a latching to a nonlatching disposition. The dispenser is of the type adapted for dispensing the consumable and the latching mechanism prevents access to the enclosed space to all individuals, excepting those authorized access.

10 Claims, 7 Drawing Figures

LATCHING MECHANISM FOR DISPENSER APPARATUS

TECHNICAL FIELD

The present invention is directed to a dispenser apparatus for dispensing a consumable, such as hand soap. Particularly, the invention is in a casing supporting a container for the consumable, which container may be replenished, and a latch mechanism for latching a closure member of the casing to the container thereby to prevent access to the enclosed space within the casing and to the container until such time as the consumable requires replenishment.

BACKGROUND ART

Dispensers of the type considered herein have been used for many years, principally in commercial establishments. Typically, when the dispenser is used in such an environment it is conventional that a closure member of the casing within which the consumable is disposed and from which the consumable is dispensed is latched or otherwise locked so that access to the interior of the casing may be gained only by persons authorized access.

Many latching and locking instrumentalities are known. For example, a pair of ears may project from respective stationary and movable parts of the casing. Each ear may include an aperture and the shackle of a padlock or other similar locking structure may be received through the apertures. Further, the closure member may be provided with a key lock mechanism including structure controlled by movement of the key into and out of an opening in a striker plate carried by the casing. All such structures function in a manner to permit access to the interior of the casing by an authorized individual and, at the same time, when the dispenser is locked, to prevent access to the interior of the casing by an unauthorized individual.

The present invention is directed to dispenser apparatus including an improved latch mechanism for limiting access to the enclosed space of a casing to individuals authorized to gain access.

SUMMARY OF THE INVENTION

The dispenser apparatus of the present invention is of the type for dispensing a consumable. As such, it is required in replenishment of the consumable for continuous use to gain access to the enclosed space. However, because of the environment of use of the dispenser apparatus access to the enclosed space is limited to authorized individuals, only.

The dispenser apparatus includes a casing defined by a body member and a closure member movable between an open position to permit replenishment of the consumable and a closed position. In a preferred form of the invention the body member is substantially rectangular in horizontal section and the closure member is mounted by a container for the consumable located within the enclosed space. The closure member includes an integral hinge so that a portion of the same moves pivotally between the open and closed positions. Thus, the body member, whose several walls extend from a base to an upper edge, may be closed by the closure member. A depending or finger gripping portion may extend from the pivotal portion of the closure member for ease in manipulation of the closure member between positions.

The dispenser apparatus also includes a latch mechanism for latching the closure member in the closed position. The latch mechanism includes a stationary latching element and a movable latching element. The movable latching element includes a base, a hub extending from the base, a rim likewise extending from the base outwardly of the hub to provide a recess therebetween, a projection within the recess at the base, an ear formed on the base, and a nose extending from the base. The nose functions to cooperatively interact with the stationary latching element for latching the closure member when the nose of the movable latching element is in a first position. A biasing means acts against the ear to normally bias the movable latching element to the first position.

In a preferred form of the invention a housing supports the movable latching element, which housing is carried by the closure member. The stationary latching element is comprised of a lip which may be located at the upper edge of the front wall of the body member or on the wall of the container juxtaposed to the front wall. In either form, the lip extends into the enclosed space. Preferably, however, the lip is formed on the container and the portion of the front wall of the body member is cut away. The depending portion of the closure member covers the cutaway region when the closure member is in the closed position.

The housing includes a base and a wall therearound terminating in a rim which supports the housing on the undersurface of the closure member. A post extends from the housing base. The movable latching element is mounted on the post and in a mounted disposition, the hub extends partially through an opening in the closure member. The end extremes of a cutout in the housing wall which faces the lip define the first position and a second position to which the nose is moved when access to the enclosed space is required. A key imparts movement to the movable latching element. To this end, the key is guided by the hub into the recess to a position at which there is a "locking" engagement of key and movable latching element. Particularly, engagement is provided by provision of a slot for each projection whereby movement of the key about the axis of the post causes movement of the nose of the movable latching element to the second position. Movement is in opposition to the normal bias of the biasing means which in the preferred embodiment is a spring confined between a wall of the housing and the ear.

Other more specific features of the dispensing apparatus will be described below.

BEST MODE FOR CARRYING OUT THE INVENTION

Figure 1:
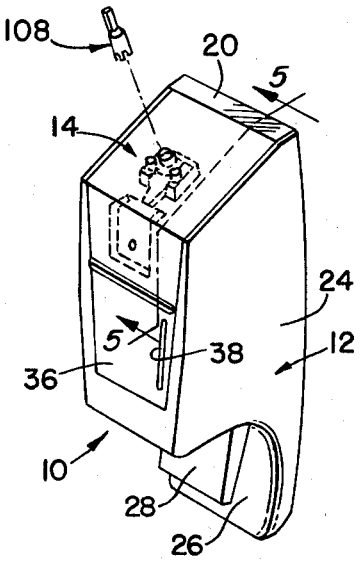
FIG. 1 is a perspective view of the dispenser apparatus of the present invention.
Figure 5:
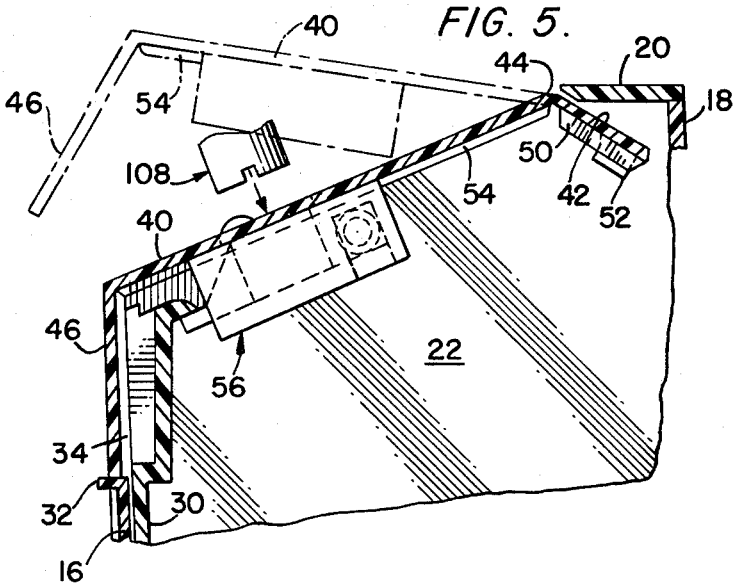
FIG. 5 is a view in section as seen along the line 5—5 in FIG. 1 illustrating the manner of latching the cover to the body of the dispenser.

A dispenser apparatus 10 includes an exterior casing formed by a body member 12 and a closure member 14. The closure member is mounted for movement pivotally with respect to the body member between open and closed positions, as seen in FIGS. 1 and 5. The body member includes front and rear walls 16, 18, top wall 20 which substantially frames an opening into the enclosed space within the casing, and a pair of opposed sidewalls 22, 24. The body member is completed by a bottom wall 26.

In a preferred embodiment, the front, top, bottom and opposed sidewalls of the body member are integral in construction. The rear wall is secured to the other walls of the body member in any convenient manner, and, in turn, provides securement of the casing on a supporting wall. For example, the rear wall may be formed with a plurality of openings each adapted to receive a screw or other fastener for mounting the rear wall on the supporting wall, and both the integral portion of the body member and rear wall may carry structure to provide for a snap fitting intercooperating engagement of parts.

The body member 12 may be of any shape. As illustrated, at least about one-half of the length of bottom wall 24 extends substantially horizontally from the front wall toward the rear wall and then is arcuate in a downward direction merging with the sidewalls to define substantially a free-standing chamber, the aforementioned enclosed space, of generally rectangular tubular outline above an open area. A lever 28 of a dispensing mechanism extends into the open area. A nozzle (not shown) through which the hand soap is dispensed likewise extends into the open area, in front of the lever. The nozzle is connected to a flexible conduit (also not shown) communicating with a container 30 mounted within the casing. The container serves as a replenishable storage vessel for the consumable.

Features of the dispenser mechanism are outside the scope of the invention and may be considered conventional.

The front wall 16 may be recessed throughout a substantial portion of its surface area. A rib 32 extends across the front wall between the sidewalls, at the upper extreme of the recess. The front wall, above the rib, is cut out at "34" (see FIG. 5). An inlay, such as a decal 36 printed to simulate a wood-grain finish and provide additional aesthetic character to the casing may be mounted within the recess. A slot 38 is formed in the front wall so that the level of the consumable within container 30 is visible. By provision of an arrow or some other marking along the length of the slot a determination may readily be made that replenishment of the consumable is required.

Closure member 14 includes a front portion 40 and a rear portion 42 on opposite sides of a hinge 44. The hinge is a so-called "living hinge", as is well-known. In the closed position, the front portion of the closure member resides within the opening framed by top wall 20, and substantially in the plane of the top wall to close the opening. A portion 46 of closure member 14 depends from the front portion and in the closed position closes the cutout 34 in front wall 16, above rib 32.

Container 30 is supported within body member 12, for example, on a platform (not shown) extending from the rear wall 18 into the enclosed space. The container includes a base (not shown) substantially coextensive in horizontal cross section with that of the enclosed space, and a plurality of walls that extend in juxtaposed relation to the front, rear and opposed sidewalls of the body member. The walls of the container extend to a rim which, when the container is located in the body member, lies in a plane slightly below the plane of top wall 20, at the framed opening. A top portion 48 of the container, providing a continuous surface is positioned below top wall 20 within the vicinity of rear wall 18.

Figure 2:
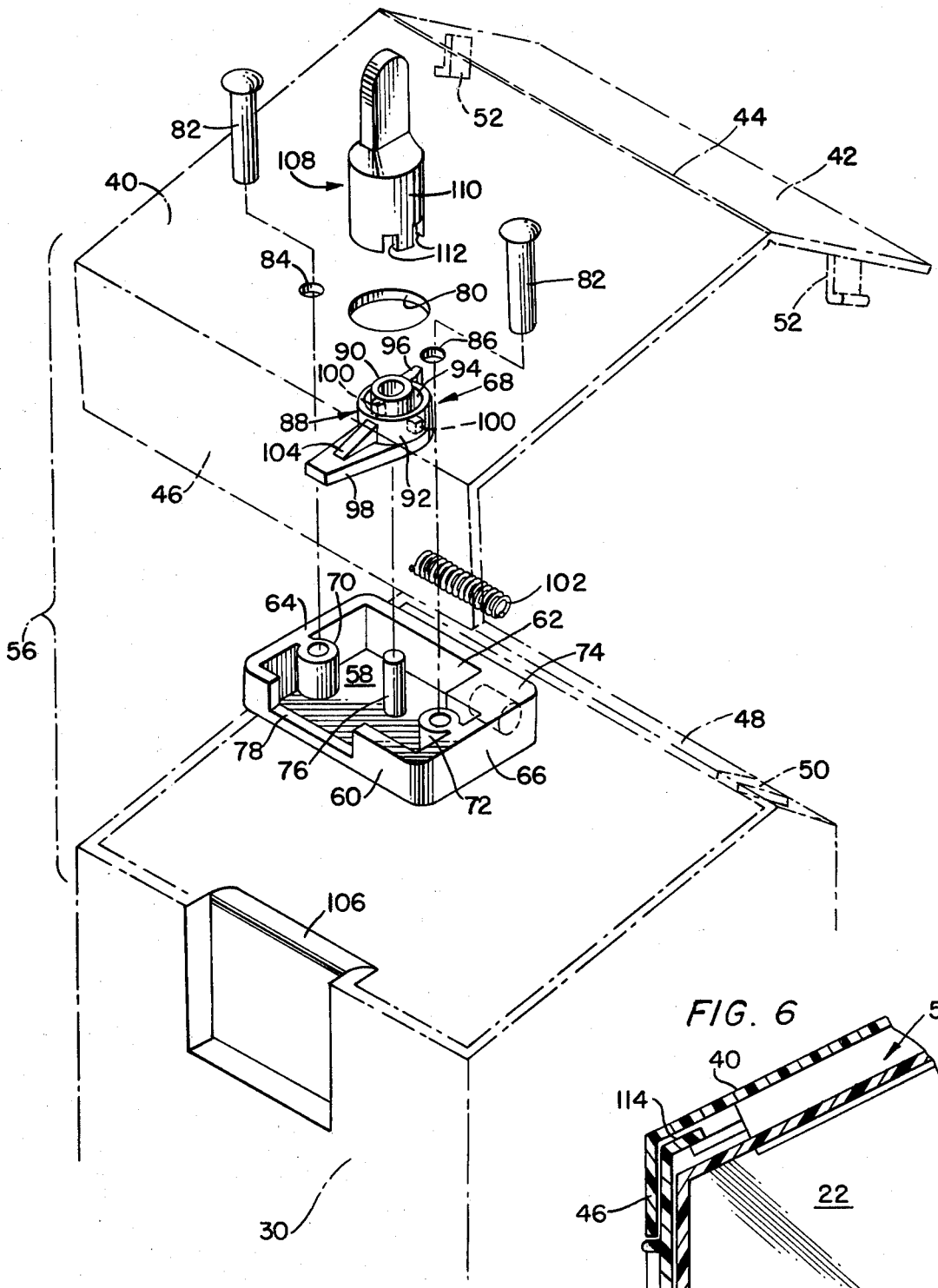
FIG. 2 is an exploded view of the latching mechanism, a portion of the casing of the dispenser apparatus, and a key which cooperates with the latching mechanism.

Referring to FIG. 2, the top portion 48 of container 30 supports the rear portion 42 of closure member 14, and the rim supports the front portion 40 of the closure member when it is in the closed position. More particularly, the rear portion is connected to the top portion in a manner to permit pivotal movement of the front portion, about hinge 44, to the open position. Any manner and means of connection may be employed. Thus, the connection may include a slot between a pair of ridges 50 at spaced locations on the underside of top portion 48 and a finger 52 carried by the rear portion 42 of closure member 14 received through each slot. A hook end on each finger, biased toward a respective sidewall, will engage with a ridge to prevent retraction of the finger through the slot. When the closure member 14 is connected to the container 30, hinge 44 will locate along the rear edge of the framed opening. Movement of the front portion 40 of the closure member will be unimpeded.

A pair of ribs 54 are located on the undersurface of front portion 40 of closure member 14. The ribs are spaced apart by a distance slightly less than the spacing of the rim of container 30 to immobilize the closure member sideways or laterally when in the closed position.

The casing of the dispenser apparatus 10 may be formed of any material, such as metal or plastic. Preferably, the casing is molded or otherwise fabricated of one of the conventionally used plastics, such as polypropylene, polystyrene or similar plastic material which provide a sturdy and durable construction in use over an extended period of time. The container 30 may be similarly formed and, as should be apparent, at least the portion of the container disposed behind and coextensive with slot 38 is of transparent material so that the level of the consumable may be seen.

Figure 3:
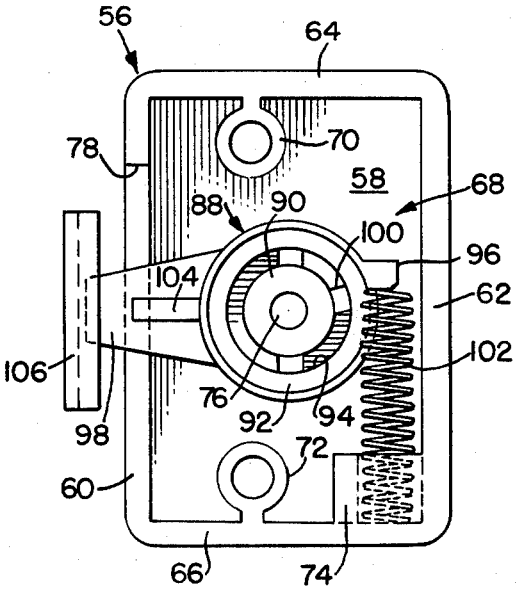
FIG. 3 is a plan view of the latching mechanism with the parts illustrated in a latching orientation.
Figure 4:
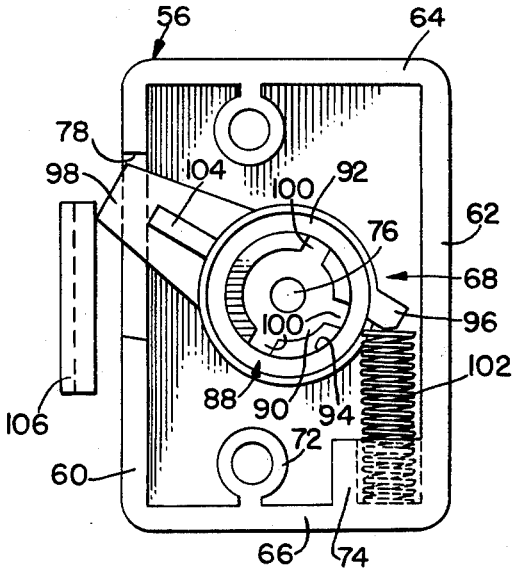
FIG. 4 is a view like that of FIG. 3 illustrating the parts in an unlatched position.
Figure 7:
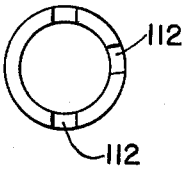
FIG. 7 is a bottom view of the key of FIGS. 1 and 5.

Referring to FIGS. 2–4, there is illustrated a latch mechanism 56, the movable latching element of which is supported by a housing including a bottom wall 58, front and rear walls 60, 62 and a pair of sidewalls 64, 66. The housing provides an open space within the confines of the several walls for receipt and unimpeded movement of the movable latching element 68 (hereafter "latch") between a first and a second position.

The housing preferably may be molded or otherwise fabricated from one of the plastic materials previously mentioned. A collar 70 is integral with sidewall 64, and a similar collar 72 is integral with sidewall 66. Each collar includes a circular bore which is coaxial with a bore (not shown) in the bottom wall 58. A seat 74 comprising an enlarged thickness of wall is formed within the region of the intersection of rear wall 62 and sidewall 66 for purposes as will be set out. Further, a post 76 is carried by the bottom wall 58 and a cutout 78 generally of rectangular outline is formed in front wall 60. As will be described, the cutout permits movement of latch 68 between first and second positions when supported on post 76.

Referring to FIG. 2, it will perhaps be seen that the post 76 extends from bottom wall 58 throughout a distance slightly in excess of the height of each of the walls 60, 62 and so forth. More particularly, the length of the post is such that it extends slightly into an opening 80 within the front portion 40 of closure member 14 when the housing is mounted to the undersurface of the closure member.

The housing of latch mechanism 56 is secured to the undersurface of closure member 14 by a pair of rivots 82. To this end, a pair of openings 84, 86 are formed in the closure member on opposite sides of opening 80 and in coaxial alignment with the bore in each of collars 70, 72. A rivot 82 is received through each bore and opening in the direction of the arrow so that the head of each rivot is disposed adjacent the bottom wall 58 of the housing. The other end of each rivot is received completely through the respective openings 84, 86. The rivots may be formed of any material, preferably of plastic, and through an application of heat or by means of some other conventional process the extending ends of the rivots may be enlarged sufficiently to prevent retraction through the opening.

Latch 68 includes a body 88, a hub 90 extending upwardly from the body and a rim 92 likewise extending upwardly from the body. The rim is spaced from the hub to provide a recess 94 therebetween. An ear 96 is formed on the rim and an extension of the body in the direction opposite the ear is characterized as a nose 98. A projection 100, and preferably a plurality of projections, are located within the recess, at the base.

The latch may comprise one of the plastic materials previously discussed, and may be formed in a manner as discussed, also.

The latch 68 is mounted on post 76 in position that hub 90 extends away from the bottom wall 58 of the housing of latch mechanism 56, and the nose 98 extends through the cutout 78. A spring 102 is located between ear 96 and the seat 74 thereby to provide a constant biasing force to locate the nose at the right end (see FIG. 2) of cutout 78, heretofore referred to as the "first position". The left end of the cutout comprises the "second position".

Hub 90 of the latch is substantially coextensive in length with post 76, while the rim 92 is somewhat shorter in length. More particularly, when the latch is mounted in the housing of latch mechanism 56, the rim will extend to a position at the height of or just below the plane of the edge of the walls 60, 62 and so forth. The rim, therefore, will serve to axially position the body 88 on post 76. A rib 104 may extend along a portion of the length of nose 98 to provide increased strength.

Referring still to FIG. 2, container 30 is formed with a lip 106 in the wall juxtaposed to front wall 16 of the body member 12. The lip is located at the rim of the container and extends inwardly toward the housing of latch mechanism 56.

In operation, the nose 98 of latch 68 is biased to the first position, and in the first position is located below lip 106 (see FIG. 3). The lip comprises the stationary latching element. To this end, the lip is immobilized relative to the body member 12 by virtue of the top portion 48 of container 30 disposed below the top wall 20 of the body member. The nose 98 of latch 68 which comprises the movable latching element is immobilized axially by the hub 90 acting against the lower surface of closure member 14 when the housing of the latch mechanism 56 is mounted, as heretofore discussed. When the nose is in the first position movement of the closure member, more particularly the front and depending portion 40, 46, about hinge 44 is restrained. The casing, therefore, is locked and access to the enclosed space is prevented. A key 108 permits access to the enclosed space to replenish the consumable.

Key 108 includes an operative portion defined by cylindrical body 110 of a dimension substantially equal to that of recess 94 of body 88 and a slot 112 to accommodate each projection 100. The preferred embodiment of the invention a plurality of three projections are located within the recess. Two of the projections may be located at diametric opposite positions, and the third projection may be located at some nonsymmetrical position therebetween. For example, the third projection may be located in position so that a vertical plane through the center of the projection is angularly disposed closer to one of the other projections. This arrangement of projections and many others will prevent tampering and substantially prevent operation in unlatching by makeshift probes. The key will include a like plurality of slots, with like arrangement. In operation, the key is located into the recess to a position that each projection enters into a slot. The hub 90 provides a guide surface in this movement. The projections and slots serve to engage the key and latch, and rotation of the key against the bias of spring 102 will result in a following movement of the latch whereby nose 98 pivots from the first position to the second position (see FIG. 4). As should be apparent, the key and latch have two engaging positions. Other arrangements of projections and slots may be provided, as desired. In movement toward the second position the nose moves out from under lip 106 and ultimately withdraws from the region of the lip. The front portion 40 of closure member 14, therefore, may be pivoted about hinge 44 to an open position to permit replenishment of the consumable. The key 108 will also serve to lock the closure member, once again by movement of the nose 98 of the latch to the second position as the closure member is pivoted to the closed portion. The spring 102 will return the nose to the first position to lock the closure member.

Figure 6:
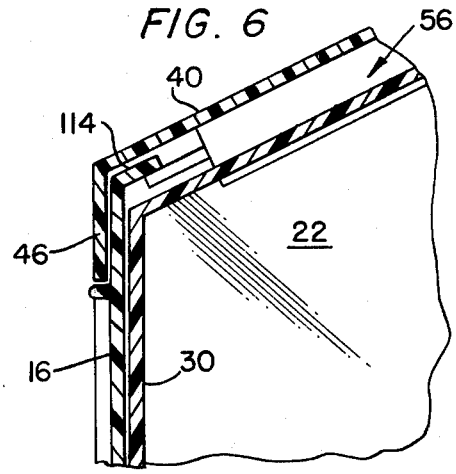
FIG. 6 is a partial view similar to FIG. 5 of a second form of latching the cover to the body of the dispenser.

In an alternative embodiment (see FIG. 6), a lip 114 may be formed on the front wall 16. To this end, the front wall would extend upwardly beyond rib 32 toward the top wall 20 and the front wall of container 30 would be formed to accommodate the lip and movement of the movable latching element as heretofore discussed.

I claim:

1. Dispenser apparatus for repeated use in dispensing a consumable through an outlet opening, said dispenser apparatus including a casing having a body member both for supporting a container for said consumable and enclosing said container within a space, and a closure member mounted on said body member to close said space preventing access to said consumable; means mounting said closure member for movement between an open position to permit replenishment of said consumable and a closed position; latching means for latching said closure member in said closed position to prevent substantially unauthorized access to said space, said latching means including a stationary latching element carried by one of said body member and container, a movable latching element carried by said closure member, said movable latching element including a base, a hub extending from said base, a rim likewise extending from said base and spaced outwardly of said hub to define a recess therebetween, at least one projection within said recess at said base, an ear extending from said base, means for mounting said movable latching element to said closure member, means for biasing said movable latching element to a first position, means carried by said mounting means for supporting one end of said biasing means whose other end is supported by said ear, and a nose extending from said base to cooperatively interact with said stationary latching element for latching said closure member when said movable latching element is in said first position; said mounting means also supporting said movable latching element for movement from said first position; and a key having an operative portion to be received in said recess, said operative portion having a slot equal in number and spaced apart in accordance with the spacing of each said projection, each said projection being received in a slot to engage said key and movable latching element whereby movement of said movable latching element in opposition to said biasing means in following movement of said key results in movement of said movable latching element from said first position toward a second position for release of said cooperative interaction between latching elements.

2. The dispenser apparatus of claim 1 wherein said stationary latching element comprises a lip carried by said container.

3. The dispenser apparatus of claim 2 wherein said stationary latching element includes a lip disposed at an edge of said container which provides a supporting surface for said closure member in said closed position, and wherein said closure member is connected to said container and includes an integral hinge providing an axis about which a front portion of said closure member moves between said positions.

4. The dispenser apparatus of claim 1 wherein said mounting means includes a housing, said housing having a base, a peripheral wall extending from said base to an edge substantially parallel to said base which is adapted to be disposed in juxtaposition to the undersurface of said closure member, and a post extending upwardly from said base, an opening formed in said closure member, means for mounting said housing to said closure member so that said edge is in juxtaposition to said undersurface and said post is located coaxially with respect to said opening, and said movable latching element received on said post.

5. The dispenser apparatus of claim 4 wherein said hub is of a length to extend partially through said opening thereby to provide a guide surface for said key in movement into said position of cooperative interaction.

6. The dispenser apparatus of claim 4 wherein said stationary latching element comprises a lip carried by said container, said lip extending into said space and toward one wall of said housing, said one wall having a cutout, one end of said cutout defining said first position and the other end of said cutout defining said second position, and said nose extending through said cutout whereby in said first position said nose is disposed under said lip and in said second position said nose is removed from the region below said lip.

7. The dispenser apparatus of claim 4 wherein said ear extends in one direction from said base of said movable latching element and said nose extends in substantially the opposite direction, and wherein said supporting means for said biasing means includes a seat in said wall of said housing, said seat supporting said one end of said biasing means whose other end is supported by said ear.

8. The dispenser apparatus of claim 7 wherein said biasing means includes a compression spring, said spring acting between said seat and said ear to bias said nose normally to said first position.

9. The dispenser apparatus of claim 4 wherein said means for mounting said housing on said closure member includes a pair of collars carried by said base, each collar including a bore extending completely therethrough and through said base, an opening formed in said closure member in coaxial relationship with each said bore, and means engaged with the upper surface of said closure member and the lower surface of said base thereby to permanently locate said housing on said closure member.

10. The dispenser of claim 1 wherein said recess is annular in outline, and including three projections within said recess, two of said projections located at diametrically opposed locations and the third of said projections being disposed nonsymmetrically relative to said two projections.

* * * * *